US009082535B2

(12) United States Patent
Blakes et al.

(10) Patent No.: US 9,082,535 B2
(45) Date of Patent: Jul. 14, 2015

(54) METHOD AND APPARATUS FOR ORDERLY RUN-DOWN OF SUPERCONDUCTING MAGNETS

(75) Inventors: Hugh Alexander Blakes, Longworth (GB); Adam Paul Johnstone, Thame (GB)

(73) Assignee: Siemens PLC, Camberley (GB)

( * ) Notice: Subject to any disclaimer, the term of this patent is extended or adjusted under 35 U.S.C. 154(b) by 66 days.

(21) Appl. No.: 14/116,644

(22) PCT Filed: Mar. 16, 2012

(86) PCT No.: PCT/EP2012/054737

§ 371 (c)(1), (2), (4) Date: Dec. 9, 2013

(87) PCT Pub. No.: WO2012/152484

PCT Pub. Date: Nov. 15, 2012

(65) Prior Publication Data

US 2014/0085021 A1 Mar. 27, 2014

(30) Foreign Application Priority Data

May 10, 2011 (GB) ..... 1107765.8

(51) Int. Cl.

| | |
|---|---|
| ***H01F 6/06*** | (2006.01) |
| ***H01F 6/02*** | (2006.01) |
| ***H01F 6/04*** | (2006.01) |
| ***H01F 6/00*** | (2006.01) |

(52) U.S. Cl.

CPC ..... *H01F 6/02* (2013.01); *H01F 6/003* (2013.01); *H01F 6/008* (2013.01); *H01F 6/04* (2013.01)

(58) Field of Classification Search

USPC ..... 361/19; 505/163, 220

See application file for complete search history.

(56) References Cited

U.S. PATENT DOCUMENTS

| | | | | |
|---|---|---|---|---|
| 4,695,932 | A | 9/1987 | Higashino | |
| 5,514,915 | A | 5/1996 | Kim et al. | |
| 5,610,985 | A * | 3/1997 | Ten Kate | 381/27 |
| 5,953,224 | A | 9/1999 | Gold et al. | |
| 6,215,202 | B1 | 4/2001 | Luongo et al. | |
| 6,317,303 | B1 * | 11/2001 | Zeigler et al. | 361/19 |
| 6,560,969 | B1 | 5/2003 | Eckels | |
| 8,385,033 | B2 | 2/2013 | Gebhardt et al. | |
| 2002/0002116 | A1 | 1/2002 | Buckles et al. | |
| 2005/0062473 | A1 | 3/2005 | Ryan et al. | |

FOREIGN PATENT DOCUMENTS

| | | |
|---|---|---|
| JP | 2005065400 | 3/2005 |

* cited by examiner

*Primary Examiner* — Danny Nguyen

(74) *Attorney, Agent, or Firm* — Schiff Hardin LLP

(57) ABSTRACT

In a method and apparatus for maintaining operation of ancillary equipment associated with a superconducting magnet carrying a DC current, the DC current is directed through a DC-to-AC converter, and the magnitude of the current flowing through the superconducting magnet is ramped down at a controlled rate, thereby generating a controlled voltage across a controlled impedance, and powering the ancillary equipment by the controlled voltage and an associated current, and the ramping rate is controlled in order to maintain a required controlled voltage.

5 Claims, 2 Drawing Sheets

METHOD AND APPARATUS FOR ORDERLY RUN-DOWN OF SUPERCONDUCTING MAGNETS

BACKGROUND OF THE INVENTION

1. Field of the Invention

The present invention relates to superconducting magnets, and more particularly to a method and apparatus to enable an orderly run-down of the magnet in the case of failure of the power supply to the refrigerator.

In particular, the present invention relates to a method and apparatus that enable energy stored within the magnetic field of a superconducting magnet to be used to continue operation of a refrigerator, cooling superconducting current leads and the afore-mentioned superconducting magnet to below their transition temperature for long enough to ensure a controlled run-down of the current in the magnet, avoiding a quench and dissipating heat outside of the cryostat.

2. Description of the Prior Art

Typically, superconducting magnets are housed in a cryostat, which keeps the magnet below its transition temperature. While this was once achieved by providing a bath of liquid cryogen, more recent designs have the magnet in a vacuum, cooled by conduction over a thermal link to a cryogenic refrigerator. In such arrangements, is has become common to provide an electrical current lead from the magnet to an externally accessible terminal, of which at least part is formed of a high-temperature superconductor (HTS). In such arrangement, the refrigerator must be kept operating continuously, since thermal leakage into the cryostat will rapidly heat parts of the magnet and/or the HTS part of the current lead to above the superconducting transition temperature if refrigeration were to cease.

A problem therefore occurs with a refrigerator which is electrically powered (as is typical), in the case of failure of the electrical supply. As is well known, electric current continues to flow in a superconducting magnet, even in the absence of an applied voltage. The present invention seeks an orderly way of reducing this current before a quench initiates in the magnet or the HTS part of the current lead, which may be referred to below as the HTS current lead.

An alternative approach is to intentionally induce a quench, which is spread throughout the material of the magnet, so that no part of the magnet is raised to a temperature high enough to suffer damage. However, this approach still causes a large temperature rise to the magnet, leading to significant down-time while the magnet is re-cooled. The quench may also cause some movement of wires or coils in the magnet, which may mean that a time-consuming re-shimming process needs to be carried out.

SUMMARY OF THE INVENTION

The present invention accordingly provides methods and apparatus as set forth in the appended claims.

The method and apparatus of the present invention provide for the use of energy stored within the magnetic field of the magnet to be used to power the refrigerator, keeping the magnet and the HTS current lead below their transition temperature for a time long enough to enable the orderly run-down of current in the magnet.

DESCRIPTION OF THE PREFERRED EMBODIMENTS

According to the present invention, control methods and apparatus are provided which detect the failure of power supply to the cryogenic refrigerator, direct energy from the magnet to a converter which converts the energy into a form which is useful to power the cryogenic refrigerator, and power the cryogenic refrigerator using the converted power. In this way, the refrigerator continues to operate until substantially all of the energy stored in the magnet has been dissipated, as that energy is dissipated in powering the refrigerator itself. There therefore remains insufficient energy within the magnet to cause any harm to the magnet or current leads, or cause an appreciable temperature rise in the magnet or current leads once the refrigerator has stopped working.

Figure 1:
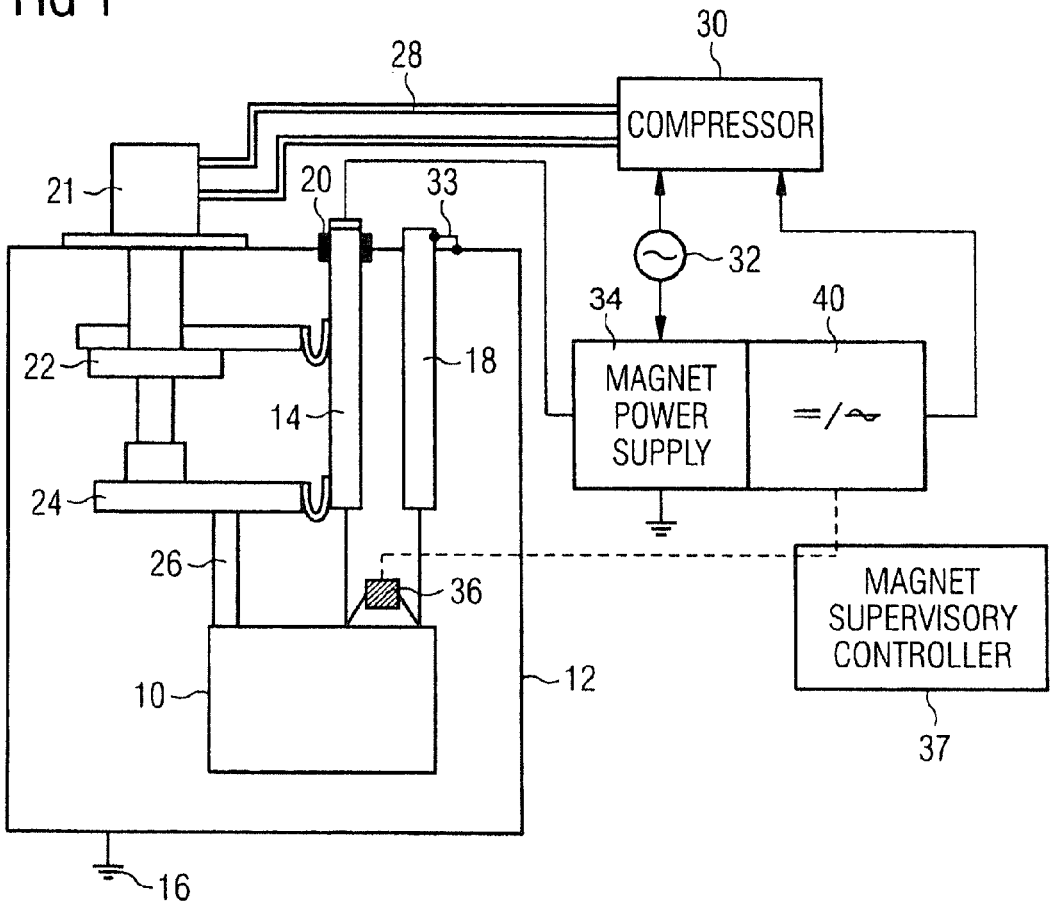
FIG. 1 shows a schematic diagram of a cryogenically cooled superconducting magnet modified according to the present invention.

FIG. 1 schematically illustrates a superconducting magnet 10 housed within a cryostat comprising an outer vacuum chamber (OVC) 12. In magnetic resonance imaging (MRI) equipment, both the magnet and the OVC are commonly cylindrical, although this is not apparent from the schematic representation of FIG. 1.

A current lead 14 is electrically connected to the magnet, and is accessible from outside the OVC 12. This may be achieved by passing the current lead 14 through an insulating bushing 20, which electrically insulates the current lead 14 from the material of the OVC, which is typically stainless steel. The OVC is typically earthed 16, and the magnet 10 is usually electrically earthed to the OVC through the earth connection 18. Cryogenic refrigerator 21 typically has two refrigeration stages. The first refrigeration stage 22 typically cools to a temperature in the range 50-80K. The second refrigeration stage 24 typically cools to a temperature of about 4K. In a complete system, thermal radiation shields are provided between the magnet and the OVC, although they are not shown in FIG. 1. One of these shields may be thermally linked to the first stage 22 and cooled to about 50K, while the other shield may be thermally linked to the second stage 24 and cooled to about 4K. A thermal link 26 between magnet 10 and second stage 24 ensures cooling of the magnet 10 to below its superconducting transition temperature. Refrigerator 21 is operated by compressed gas, such as helium, which is passed to, and retrieved from, the refrigerator along gas flow lines 28. Compressor 30 is operated by an electrical power source 32 such as mains electricity or a private generator. Compressor 30 compresses the gas and supplies it to the refrigerator 21. Magnet power supply unit 34 is also operated by an electrical power source 32 such as mains electricity or a private generator. Magnet power supply unit 34 converts received electrical power into a form suitable for application to the magnet. For example, it may receive three-phase AC power at 415V from electrical power source 32 and convert it into a DC supply at SV, with a current capacity of 500 A or more.

Ground link 33 connects earth connection 18 to the body of the OVC 12. It may be constructed in a manner similar to that of current lead 14. No insulating bushing 20 is required, although the earth connection must be sealed to the OVC in a vacuum tight manner, and electrically connected 33 to the OVC.

As is well known in the art, when the magnet 10 is brought into operation, compressor 30 must provide compressed gas to the refrigerator 21, which must cool the magnet 10 until it is below the transition temperature of the wire from which it is made. Once the temperature of the magnet has stabilized in this condition, current is supplied from power supply unit 34. This is done gradually and progressively by ramping the magnitude of the supplied current, for example at a rate of 10 A/minute. During this procedure, an appreciable amount of heat is generated in any resistive parts of the circuit, for example current lead 14. The ground connection 18 and at least part of the current lead 14 may contain superconducting wire, or high-temperature-superconducting (HTS) wire, which will reduce the amount of heat generated.

Once the magnet is in its operating condition, with the required current flowing in it, superconducting switch 36 can be closed, and the current flowing through the power supply unit 34 may be gradually ramped down to zero. The current in the magnet will then flow through the superconducting switch 36 in a closed superconducting circuit and no current will flow in current lead 14.

In this normal operating mode, the compressor 30 and the refrigerator 21 must continue to operate, powered by electrical power source 32 and power supply unit 34, to prevent heat influx into the OVC 12 from heating the magnet to above its transition temperature and causing a quench. Provided that the compressor 30 and the refrigerator 21 continue to operate, the magnet may remain in this state for extended periods of time, generating a magnetic field for use in applications such as magnetic resonance imaging (MRI).

If, for any reason, the power supply 32 should fail, the refrigerator 21 will cease to cool the magnet. Heat influx through the OVC will cause the temperature of the magnet and the HTS current lead to rise. Typically, this heat rise will reach the point of quenching the magnet about 10 minutes after the refrigerator stops working.

The present invention aims to increase the time between the failure of power supply 32, and the magnet reaching a temperature high enough to cause a quench, as well as ramping down the current within the magnet so that when the magnet reaches a temperature high enough to cause a quench, there will be little or zero current left in the magnet.

The present invention addresses both of these requirements by providing a method and apparatus for converting energy stored in the magnet into energy required for operating the refrigerator 21. In this way, the refrigerator continues to operate for longer, and the energy stored in the magnet is progressively dissipated. When the energy remaining in the magnet is insufficient to continue to power the refrigerator, the refrigerator will cease to operate and the magnet will warm up until a quench occurs. However, at this time, there will be little energy left in the magnet, and the quench should not cause any damage to the magnet, and should not cause a large temperature rise within the magnet.

The magnet will then remain in this state: no current flowing, and above the transition temperature of the superconductor, until the power supply 32 is restored.

Once the power supply 32 is restored, compressor 30 will again provide compressed gas to the refrigerator, which will begin to cool the magnet back to its operating temperature, and operation as described above may re-commence.

A challenge in this invention is to convert the energy stored in the magnet into a form suitable for powering the compressor 30 to keep the refrigerator 21 operating. The energy stored in the magnet is stored in the magnetic field produced by the magnet. This magnetic field, together with the large inductance L of the coil, resists any change in current flowing through it. As is well known, any change in current will be accompanied by a voltage proportional to the rate of change of the current: $V=L\cdot d\,I/dt$. However, in a superconducting magnet, the voltage across any turn is necessarily zero, so $d\,I/dt$ must also be zero.

In normal operation, a current flows through the magnet 10 and through superconducting switch 36. A magnet supervisory system 37 is used to sense a loss of power from power source 32 and to open the superconducting switch 36 which initiates the run-down of the magnet. If a failure of the power supply 32 is detected by the magnet supervisory controller 37, the controller opens superconducting switch 36, and the current flowing in the magnet then flows through current lead 14, OVC 12 and earth connection 18 to power supply unit 34. The power supply unit 34 then receives a DC current from the magnet. The power supply unit 34 and controller 37 include a DC-to-AC converter 40, known in itself, to convert the DC current supplied by the magnet into a form suitable for supply to compressor 30. In other embodiments, different converters may be provided, according to the type of power source required by the compressor 30. A voltage will be generated across the power supply unit 34 and the resistive parts of the current path 14, 12, 18, dependent on the rate of reduction of the current in the magnet according to $V=L\cdot d\,I/dt$. By selecting an appropriate rate of decrease of current in the magnet, an appropriate and relatively stable power may be derived with which to operate the compressor 30.

The amount of energy stored in the magnet is proportional to $I^2$, and so the amount of energy extracted from the magnet in reducing the current flowing in the magnet from $I_1$ to $I_2$ over a period of 1 minute is proportional to $(I_1^2-I_2^2)$, and the average power obtained by doing so is proportional to $(I_1^2-I_2^2)/60$ watts. To maintain a constant power output from the magnet, the rate of reduction in the current in the magnet must be increased as the magnitude of the current diminishes.

In an example, the compressor 30 may require 6 kW of electrical power to operate the refrigerator 21. Assuming a conversion efficiency of 75%, this means that energy must be removed from the magnet at a rate of 8 kW to power the refrigerator. In an example 3 T magnet operating with a current of 500 A when a failure of power source 32 is detected, a ramp rate of −10 A/minute until the current in the magnet reaches 400 A will provide the required average power of 8 kW for 10 minutes. However, a ramp rate of −30 A/minute will be required for magnet currents between 200 A and 100 A, to continue to release 8 kW of power for 3.33 minutes. Of course, the controller 40 will typically adjust the ramp rate more frequently than this, to keep the power supplied to the compressor 30 relatively constant.

Such an example 3 T magnet stores about 12 MJ of energy when in operation. Assuming that the apparatus of the present invention controls the ramp rate perfectly to derive a constant 8 kW from the magnet, those 12 MJ would keep the compressor 30 running for 12000000/8000=1500 seconds, or 25 minutes. In reality, imperfect ramp rate control is likely to reduce this time.

On many MRI magnets constant power operation is also practically limited by diodes connected across the magnet current leads. These diodes will limit the voltage across the current leads and therefore limit the maximum ramp rate of the magnet.

Accordingly, in an idealized example, the refrigerator 21 is kept operational despite an interruption of electrical power for up to 25 minutes. If the electrical power is restored during that time, the compressor continues to operate, and the magnet current may be ramped back up to operating current without any interruption for re-cooling the magnet. If the interruption of electrical power lasts somewhat longer than 25 minutes, then the time taken to re-cool the magnet to operating temperature will have been reduced by the appropriate time. If the interruption of electrical power lasts much longer than 25 minutes, then the re-cooling of the magnet may take just as long as in conventional arrangements, but the invention will have provided a controlled run-down of the magnet and avoided any possible heating of the magnet which might otherwise have been caused by a quench.

In particular embodiments of the present invention, the current lead 14 comprises a high temperature superconductor (HTS) part. This is intended to reduce the heat load on the refrigerator mainly during persistent mode operation, since the heat leak of the HTS part of the current lead 14 is low. Typically, the HTS part of the lead extends only between the first 22 and second 24 stages of the refrigerator, with typically brass used above the first stage of the refrigerator, and the superconducting material of the magnet used below the second stage. The HTS part is designed to have a greater thermal resistance than the brass part, and so will limit the amount of thermal influx through the material of the current lead 14.

Figure 2:
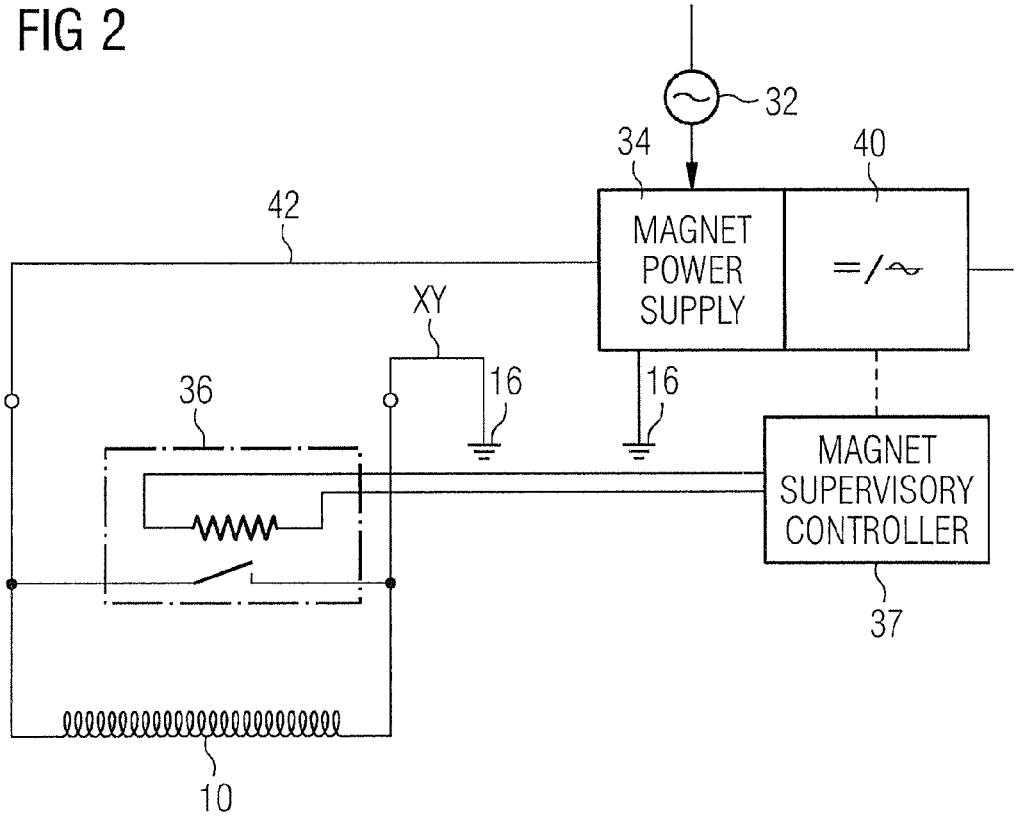
FIG. 2 schematically illustrates the control required to initiate the run-down of the magnet by opening the superconducting switch.

FIG. 2 shows more detail of the control circuitry described above, as an electrical schematic. Magnet coils 10 are bypassed by superconducting switch 36. The superconducting switch 36 is controlled by magnet supervisory controller 37. Magnet supervisory controller is connected to magnet power supply 34 and DC-to-AC converter 40, to sense a failure of power supply 32. Magnet power supply 34 is grounded 16, receives power from power supply 32 and produces a DC output 42 to one side of the magnet 10. The other side of the magnet 10 is grounded 16.

In any ramping-down of the magnet, particularly where the refrigerator is inoperative, there is a risk that the current flowing through the current lead will cause the HTS part to heat above its transition temperature and become resistive. Once it has become resistive, a large amount of heat will be dissipated in the HTS current lead, which may be damaged by the heat.

The thermal inertia of the magnet will keep the superconducting wire in the magnet coils below the transition temperature for a certain period of time. As is well known, materials have low thermal capacities at cryogenic temperatures, and in an example it is estimated that this time period between power loss and the magnet quenching is in the order of 10 minutes. This example, of 10 mins, assumes a specific heat of copper of 0.2 J/kg/K; a magnet mass of copper of 3000 kg, an allowable magnet coil temperature rise of 0.5 K, and a heat input into the 4 K mass of 0.5 W. When the superconducting wire exceeds the transition temperature the magnet will quench.

To completely ramp down the current in the magnet in this time period would require a ramp rate of −50 A/minute, which is likely to be unacceptable because of the high heat loads that occur in superconducting coils when they are ramped quickly which can lead to a quench.

The end of the HTS current lead which is nearest the magnet will be cooled to some extent by the thermal inertia of the magnet. However, as described above, the magnet would only provide sufficient cooling to the HTS current lead to keep it superconducting until the magnet quenches.

The present invention allows the refrigerator to continue to operate during a ramping-down step following an interruption of the power supply, to ensure that the superconducting magnet and the HTS current leads remain superconducting long enough to ramp the magnet to zero. In the examples discussed above, the energy stored in the magnet may keep the refrigerator operating for 25 minutes after the start of the interruption to the power supply with the thermal inertia of the magnet keeping the superconducting magnet and the HTS current leads superconducting for another 10 minutes after that. The superconducting magnet and the HTS current leads are accordingly kept in superconducting state for plenty of time to allow an orderly run down of the magnet following an interruption of the power supply.

Although modifications and changes may be suggested by those skilled in the art, it is the intention of the inventors to embody within the patent warranted heron all changes and modifications as reasonably and properly come within the scope of their contribution to the art.

We claim as our invention:

1. A method for maintaining operation of a cryogenic refrigerator powered by an electrical power source and used for cooling a superconducting magnet carrying a DC current, comprising the steps of:

detecting a failure of the electrical power source, and in response to the detection of the failure of the electrical power source, performing the following steps to ensure an orderly run-down of the superconducting magnet in advance of a possible quench:

directing the DC current through a DC to AC converter;

ramping down the magnitude of the current flowing through the superconducting magnet at a controlled ramping rate, thereby generating a controlled power from the DC to AC converter;

powering the cryogenic refrigerator by the controlled power; and controlling the ramping rate in order to maintain a required controlled power.

2. A method according to claim 1 wherein the step of controlling the ramping rate comprises increasing the ramping rate as the magnitude of current flowing in the magnet decreases.

3. A method according to claim 1 wherein the step of powering the cryogenic refrigerator continues until substantially all of the energy stored in the magnet had been dissipated in operating the refrigerator.

4. Apparatus for maintaining operation of a cryogenic refrigerator powered by an electrical power source and used for cooling a superconducting magnet carrying a DC current, comprising:

a DC to AC converter;

a detector configured to detect a failure of the electrical power source, and to operate the DC-to-AC converter in response to the detection of the failure of the electrical power source;

a controlled impedance;

a superconducting switch;

connections electrically connecting the superconducting switch to the controlled voltage; and a controller configured to control a flow of DC current through the DC-to-AC converter in order to ramp down a magnitude of the DC current flowing through the superconducting magnet at a controlled rate in order to generate a controlled voltage across the superconducting switch and causing an orderly run-down of the superconducting magnet in advance of a possible quench.

5. Apparatus according to claim 4 wherein the DC-to-AC convertor is arranged to increase the ramping rate as the magnitude of the DC current flowing in the magnet decreases.

* * * * *